United States Patent [19]

Borrello

[11] 4,206,069

[45] Jun. 3, 1980

[54] TRANSPARENT DETERGENT PELLETS

[75] Inventor: Giuseppe Borrello, Anzio, Italy

[73] Assignee: Colgate Palmolive Company, New York, N.Y.

[21] Appl. No.: 928,228

[22] Filed: Jul. 26, 1978

Related U.S. Application Data

[63] Continuation of Ser. No. 806,394, Jun. 13, 1977, abandoned, which is a continuation of Ser. No. 679,305, Aug. 22, 1976, abandoned.

[51] Int. Cl.[2] ..... C11D 9/32

[52] U.S. Cl. ..... 252/122; 252/117; 252/121; 252/92; 252/134; 252/174; 252/DIG. 12; 252/DIG. 16

[58] Field of Search ..... 252/122, 121, 117, 134, 252/174, DIG. 12, DIG. 16, 92

[56] References Cited

U.S. PATENT DOCUMENTS 3,562,167 2/1971 Kamen et al. ..... 252/121

3,793,214 2/1974 O'Neill et al. ..... 252/DIG. 16

3,969,259 7/1976 Lages ..... 252/122

*Primary Examiner*—Mayer Weinblatt

*Attorney, Agent, or Firm*—Norman Blumenkopf; Herbert S. Sylvester; Murray M. Grill

[57] ABSTRACT

A composition for making transparent, non-sticky detergent particularly in pellet form comprising a soap component containing soap, a synthetic detergent component containing an anionic organic sulfonate or sulfate or a non-ionic aliphatic detergent or a mixture thereof, an organic non-volatile, high boiling solvent component and water; and methods of making such composition and pellets. Other detergent compositions employing such transparent formulations as a base matrix and including one or more fillers, builders, oxidizing agents, foamboosters, enzymes, bactericides, pigments, brighteners, sequestrants, preservatives, foam control agents, anti-redeposition agents, ultra-violet light absorbers, etc., are disclosed along with methods for producing same.

15 Claims, 1 Drawing Figure

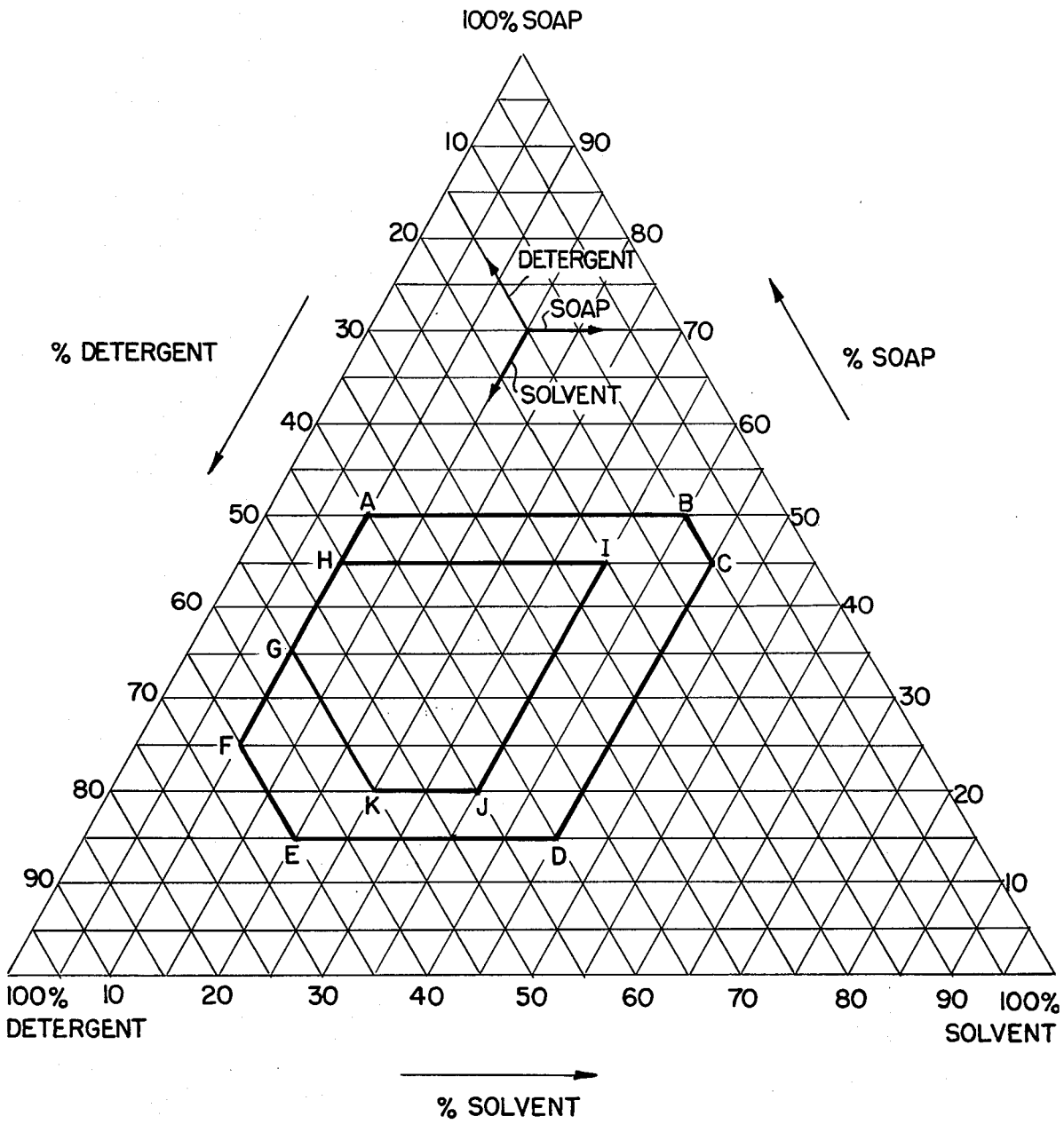
100% SOAP
10
90
20
80
DETERGENT
SOAP
30
70
% DETERGENT
% SOAP
SOLVENT
40
60
A
B
50
50
H
I
C
60
40
G
70
30
F
80
20
K
J
E
D
90
10
100% DETERGENT
10
20
30
40
50
60
70
80
90
100% SOLVENT
% SOLVENT

TRANSPARENT DETERGENT PELLETS

This is a continuation of application Ser. No. 806,394, filed June 13, 1977, which in turn is a continuation of Ser. No. 679,305, filed Aug. 22, 1976, both abandoned.

This invention relates to an improved detergent composition, and more particularly to a composition adaptable to forming into solid, transparent, form-stable, water soluble, non-sticky, free flowing substantially non-hygroscopic detergent pellets, to the pellets made from such composition, and to methods for making such composition and pellets, and to other detergent compositions produced therefrom.

Transparent soaps, and methods for their manufacture, have been well known and available for a great many years. Being costly to manufacture, they have been generally regarded as luxury items, and their transparent properties have been equated with high purity and neutrality. Such products have been used almost exclusively in the toilet articles area i.e. bathing, hand and face washing, etc. However, in common with opaque soaps, they are not acceptable for clothes laudering, their cleansing efficiency being deficient, particularly in hard water and with respect to some of the synthetic fibrous materials.

In U.S. Pat. No. 3,562,167, there are disclosed transparent detergent compositions, which compositions are said to be adaptable for forming detergent bars and cakes useful in hard water. Such compositions, bars and cakes, and the methods disclosed for their preparation, have been found to be subject to a number of disadvantages. More particularly, the products are hygroscopic whereby the resulting bars and cakes readily absorb moisture from the atmosphere, especially under conditions of high relative humidity, become sticky, and lose their transparency. Stickiness is of course peculiarly objectionable in pellet compositions of the present invention in view of the many points of contact between the pellets. Further, the products are inferior in water solubility and detergency which are of course important properties in a detergent, particularly of the pellet type.

It is an object of this invention to provide compositions, pellets and methods for their preparation which will not be subject to one or more of the above disadvantages.

Another object of this invention is the provision of an improved composition adaptable to forming into a matrix of solid, hard, transparent nonsticky, and/or substantially non-hygroscopic detergent pellets.

Another object of this invention is the provision of a method for making such compositions.

Yet a further object of this invention is the provision of a novel method for making pellets from such compositions.

A still further object is the provision of improved detergent compositions employing the matrix compositions as a base and processes for making same.

Other objects and advantages will appear as the description proceeds.

The attainment of one or more of the above objects is made possible by this invention which includes the provision of a composition adaptable to forming into solid, transparent, water soluble, form-stable, nonsticky, free-flowing, substantially non-hygroscopic detergent pellets and comprising, approximately by weight, a matrix of (A) 15 to 50% of a fatty acid soap component which is an alkali metal, alkaline earth metal (e.g. magnesium), ammonium or amine salts of $C_{6-22}$ fatty acids and mixtures thereof, said soap component providing in the matrix not more than about 30% of salts of fatty acids of more than 18 carbon atoms, and of the soap present no more than about 70% of salts of $C_{18}$ fatty acids, and no more than about 50% of salts of unsaturated fatty acids, and wherein at least about 50% of said salts present being sodium salts and no more than about 25% of said salts being potassium salts, and wherein the soap used has a weighted average carbon content of at least $C_{14}$, and wherein the carbon content of unsaturated acids is calculated on the basis of actual carbon content minus 6;

(B) 10 to 65% of a synthetic detergent component consisting essentially of at least one water soluble member of the group consisting of anionic organic sulfonates, alcohol sulfates and ether sulfates, organic phosphate esters of nonionics and nonionic aliphatic detergents, but a maximum of about 35% when said synthetic detergent component consists only of anionic organic sulfonates or alcohol sulfates or mixtures thereof;

(C) 10 to about 45% of % solvent component consisting essentially of at least one normally liquid, substantially non-volatile organic solvent having a boiling point of at least about 100° C.; and (D) 1 to 35 parts of water per 100 parts of combined components (A), (B) and (C).

The matrix compositions of this invention are set forth in FIG. 1 wherein the area bounded by the lines connecting points A, B, C, D, E and F represents such compositions and the area bounded by the lines connecting points G, H, I, J and K represents preferred matrix compositions.

Such attainment is also made possible by another feature of this invention which includes the provision of a method for preparing the above-defined composition by melting free fatty acids contained in component A, admixing therein components B and C at a temperature above the solidification point of the mixture and at such temperature and in the presence of component D, admixing therein sufficient alkali metal-, alkaline earth metal-, ammonium-, or amine-salt forming bases to saponify or neutralize said fatty acids whereby to form their alkali metal, alkaline earth metal, ammonium or amine salts in situ.

Such attainment is further made possible by still another feature of this invention which includes the provision of a method of preparing pellets from the said above-defined composition by melting said composition, and while maintaining the temperature of said composition at just above its solidification point in a container provided at the bottom with at least one small aperture, permitting the molten composition to descend from said aperture in the form of drops through an atmosphere onto a support, the atmosphere and support being maintained at a temperature sufficiently below said solidification point, and the support being positioned at a distance sufficiently below said aperture, to cause at least a substantial proportion of each drop to substantially solidify upon or prior to contacting said support, whereby generally spheroidal or hemi-spheroidal pellets are formed.

The improved detergent matrix pellets of this invention can be handled, packaged, stored and employed in much the same manner as the presently available detergent powder, granule and bead compositions, but have the added advantages of not being subject to dusting, of being less subject to caking, of being more easily handled, particularly by the human hand, and of possessing the highly desirable esthetic appeal of clear, colorless, or colored transparency. Their more water soluble, detergency, nonhygroscopic and non-sticky properties represent further improvements and advantages. The compositions of this invention are further especially adaptable to forming into the desired pellets, being formulated to provide optimum fluidity or viscosity properties when melted prior to the pellet-shaping step, and to permit the rapid solidification into pellet shape considered necessary to achieve the desired transparency, and hardness.

The matrix products of this invention provide an unique combination of both physical and chemical characteristics. As pointed out above they are transparent, stable, non-tacky, free-flowing materials which exhibit excellent detergency in a clothes laundering process, have excellent solubility characteristics particularly in the washing machine, and generally have low hygroscopicity so that they are not appreciably physically affected when in a humid environment (95–100% relative humidity).

The products of this invention generally have a soil removal ability components, if not superior, to presently used clothes laundering detergents. The detergency is conveniently measured by both the standard tergotometer (U.S. Testing Company, Hoboken, New Jersey U.S.A.) test and with practical machine washes. In the Tergotometer test an aqueous solution of detergent (0.1–0.5% concentration) is stirred with soiled swatches (and usually with clean swatches as well for redeposition effectiveness) and the detergency is then conveniently determined by "before" and "after" readings on a Color Difference meter (e.g. Gardner Color Difference Meter). The test may be run at any temperature (generally room temperature to the boil) with stirring at from 0-250 r.p.m., for 5–20 minutes (conveniently 10 minutes) at water hardnesses from 0 to 300 or more ppm (as $CaCO_3$). Prior to the "after" readings, the cleansed swatches are rinsed for a few minutes in the same hardness water as used in the detergency soap, dried and the evaluated.

The discussion speed of the products of this invention are measured in water at from room temperature to the boil (generally and conveniently at 40° C.). The method is generally to add 2 g. of product to 500 ml of water at a selected temperature and stir at selected standardized conditions until all the product is dissolved. The procedure, specifically is to use a 600 ml beaker of 12 cm height and 8.5 cm in diameter (very flat bottom) graduated every 50 ml. Place the 500 ml water in the beaker, set the temperature, add 2 g. of product and stir. The stirring is effected by means of a magnetic stirrer which is a cylindrical bar having a 1 mm. plastic coating. The overall dimensions of the bar are 12 mm. diameter and 6.2 mm. in length. The speed of rotation is adjusted to give a vortex with its apex at the 300 ml. graduation of the beaker.

The products of this invention have dissolution speeds when measured as aforedescribed of from ½ to 5 minutes at 40° C.

The penetration hardness of the products of this invention can be measured by means of the ASTM Method D217-52T (Richardson Method). Values obtained for the matrix products of this invention vary from about 40 to 75 (tenths of a millimeter).

The product stickiness (also spreadability and transferability by rubbing) is determined by rubbing under a 2 kg weight of a molded 1" cylinder of product on a standard cotton cloth (10 cm. long) and measuring the amount of product released by friction as the cloth is pulled under the weighted cylinder. Suitable products have friction values (transferability factors) of about <50 mg. to 200 mg. of product per 10 cm strip of cotton cloth. Preferred products have transferability factors of from <50 mg. to about 100 mg.

The product transparency is conveniently measured by means of a lamp photocell/galvanometer system, reading the percentage of transmitted light after a zero adjustment. Spectrocolorimeters can also be used. Substantially total transparency (i.e. ≧95%) can be achieved with the products of this invention.

Other relevant parameters of the products of this invention are the solidification temperature (S.P.) and viscosity of the product in the fluid state since these are important considerations in processing the instant compositions particularly into the shaped forms hereinbefore described. These parameters have a direct effect on rate of production, size and handling of such shaped forms (e.g. pellets) as well as effecting the transparency, stickiness and flowability of the final product. Generally the S.P. of the matrix products of this invention range from about 40° C. to 100° C. and the viscosity, as measured by a falling ball visometer, may range from about 50 cps to 3000 cps with most suitable values in the range of about 1000–2000 cps.

Subject to the limitations discussed below, the fatty acids employed in making the soaps of component A herein may contain about 6 to 22 or more, preferably about 8 to 18 carbon atoms, may be of animal, vegetable, mineral or synthetic origin, and may be saturated or unsaturated, and straight, mono- or polybranched chain hydrocarbon carboxylic acids. As merely illustrative of such acids, there may be mentioned caproic, caprylic, capric, lauric, myristic, stearic, oleic, elaidic, isostearic, palmitic, undecyleric, tridecylenic, pentadecylenic, 2-lower alkyl higher alkanoic (such as 2-methyl tridecanoic, 2-methyl pentadecanoic or 2-methyl heptadecanoic) or other saturated or unsaturated fatty acids. Dicarboxylic acids may also be used, such as dimerized linoleic acid. Other higher molecular weight acids as rosin or tall oil acids, e.g., abietic acid, may be employed.

For the attainment of optimum solubility, hardness, viscosity, melting and solidifying properties, mixtures or blends of the above and other types of fatty acids are preferably employed containing no more than about 10% of fatty acids containing more than 18 carbon atoms, and preferably at least about 5% but no more than about 70% of 18 carbon atom fatty acids. One preferred class of fatty acid blends may for example contain about 0–5% of $C_8$, 0–10% of $C_{10}$, 0–30% of $C_{12}$, 0–20% of $C_{14}$, 10–50% of $C_{16}$ and 5–70% of $C_{18}$ saturated fatty acids. Readily available commercial blends, and mixtures of such blends for obtaining the most suitable distribution of fatty acids, which may be employed include distilled palm and palm kernal oil fatty acids, distilled coconut oil fatty acids, hydrogenated tallow fatty acids, and commercial stearic acid. The fatty acid content, in parts by weight, of several such blends, and mixtures thereof, are illustrated in the following table:

TABLE A

| | A | B | C | D | E | F | G | H |
|---|---|---|---|---|---|---|---|---|
| $C_8$ | — | 4.0 | — | 2.0 | — | 2.0 | 1.3 | 2.7 |
| $C_{10}$ | — | 3.0 | 8.6 | 1.5 | — | 1.5 | 1.0 | 2.0 |
| $C_{12}$ | — | 45.0 | 66.2 | 22.5 | — | 22.5 | 5.0 | 30.1 |
| $C_{14}$ | 3.0 | 19.0 | 25.0 | 11.0 | — | 9.5 | 8.3 | 13.7 |
| $C_{16}$ | 30.0 | 11.0 | — | 20.5 | 50 ± 5 | 30.5 | 23.7 | 17.4 |
| $C_{18}$ | 65.0 | 4.0 | — | 34.5 | 43 ± 4 | 23.5 | 44.6 | 24.3 |
| Max. UnSat. | 2.0 | 12.0 | — | 7.0 | 4.0 | 8.0 | 5.0 | 8.7 |

In the above table, blend A=commercial hydrogenated tallow fatty acids

B=commercial distilled coconut oil fatty acids

C=commercial synthetic fatty acids

D=1:1 mixture of A and B (preferred)

E=commercial stearic acid

F=1:1 mixture of B and E

G=2:1 mixture of A and B

H=1:2 mixture of A and B

For the in situ saponification of these fatty acids according to the process of this invention there may be employed any alkali metal-, alkaline earth metal-, ammonium-, or amine-salt forming base, as for example sodium, potassium, magnesium or ammonium hydroxides, mono-, di- or triethanol-, or -propanol-amines, or any other such base yielding a water soluble salt or soap of the fatty acid being saponified. The base is preferably in the form of a concentrated aqueous solution, for example of about 20 to 49% concentration, and at about the temperature of the molten fatty acid when admixed therewith. An approximately stoichiometric amount of base is preferably employed unless a product is desired containing slight amounts of excess fatty acid or base.

The component A soap, apart from its known detergency function, contributes body, hardness and nonsticky properties to the pellets of this invention. However, the use of more than about 50% of component A in preparing the matrix products of this invention unduly raises the melting or fluidizing temperature (to about 110° C. or more), the viscosity of the hot, molten fluid, and the rate of solidification thereof, thereby preventing proper operation of the pellet-making process of the invention, and tends to unduly reduce the transparency and rate of dissolution of the resulting pellets. The use of less than about 15–20% of component A, on the other hand, unduly reduces the viscosity of the hot, molten fluid and the rate of solidification thereof, in addition to yielding pellets which are too soft and sticky at any level (proportion) of components B and C.

In general, it is preferred to employ the fatty acid soap component A in the form of their alkali metal salts, such as the potassium and, more preferably, sodium salts or mixtures thereof. Too high a proportion of potassium soaps has been found to yield products which are unduly opaque and soft, and accordingly no more than about 25% of the component A soaps should be potassium soaps. Preferably at least about 50%, up to 100% of component A should be sodium soaps.

The matrix compositions and pellets of this invention may contain about 15 to 50%, preferably about 20 to 45%, and still more preferably about 25 to 35% of component A, of which preferably at least about 40% are preferably the alkali metal salts of hydrogenated tallow fatty acids and at least about 35% are preferably the alkali metal salts of distilled coconut oil fatty acids.

As component B there may be employed substantially any water soluble synthetic organic detergent, or mixtures thereof, of the anionic sulfonate and sulfate and nonionic aliphatic types, ample descriptions of which appear in McCutcheons's "Detergents and Emulsifiers," 1969 Annual, and in "Surface Active Agents" by Schwartz, Perry and Berch, Vol. II, 1958 (Interscience Publishers), which descriptions are incorporated herein by reference.

Suitable anionic water soluble detergents include the alkyl aryl sulfonates, especially the higher alkyl (10–20 carbon atom) benzene sulfonate salts, preferably linear alkyl benzene wherein the alkyl group contains 10 to 16 carbon atoms. The alkyl group is preferably linear and especially preferred are those of average alkyl chain lengths of about 11 to 13 or 14 carbon atoms, such as the linear dodecyl benzene sulfonate salts.

Preferably also, the alkyl benzene sulfonate has a high content of the meta isomer and a correspondingly low content (well below 50%) of the ortho and para isomers. One suitable type of such detergent is described in U.S. Pat. No. 3,320,174.

Also, typical of the useful anionic detergents are the olefin sulfonate salts. Generally they contain long chain alkenyl sulfonates or long chain hydroxyalkane sulfonates (with the OH being on a carbon atom which the not directly attached to the carbon atom bearing the —$SO_3$ group). More usually, the olefin sulfonate detergent comprises a mixture of these two types of compounds in varying amounts, often together with long chain disulfonates or sulfate-sulfonates. Such olefin sulfonates are described in many patents, such as U.S. Pat. Nos. 2,061,618; 3,409,637; 3,332,880; 3,420,875; 3,428,654; 3,506,580; and British Pat. No. 1,139,158, and in the article by Baumann et al in Fette-Seifen-Anstrichmittel, Vol. 72, No. 4, at pages 247–253 (1970). All the above-mentioned disclosures are incorporated herein by reference. As indicated in these patent and the published literature, the olefin sulfonates may be made from straight chain alpha-olefins, internal olefins, olefins in which the unsaturation is in a vinylidene side chain (e.g., dimers of alpha-olefin), etc., or more usually, mixtures of such compounds, with the alpha-olefin usually being the major constituent. The sulfonation is usually carried out with sulfur trioxide under low partial pressure, e.g., $SO_3$ highly diluted with inert gas such as air or nitrogen or under vacuum. This reaction generally yields an alkenyl sulfonic acid, often together with a sultone. The resulting acidic material is generally then made alkaline and treated to open the sultone ring to form the corresponding hydroxyalkane sulfonate and/or alkenyl sulfonate. The number of carbon atoms in the olefin is usually within the range of about 10 to 25, more commonly about 12 to 20, e.g., a mixture of principally $C_{12}$, $C_{14}$ and $C_{16}$, having an average of about 14 carbon atoms or a mixture of principally $C_{14}$, $C_{16}$ and $C_{18}$, having an average of about 16 carbon atoms.

Another class of water soluble synthetic organic anionic detergents includes the higher (10 to 20 carbon atoms) paraffin sulfonates. These may be the primary paraffin sulfonates made by reacting long chain alpha-olefins with bisulfite, e.g., sodium bisulfite, or paraffin sulfonates having the sulfonate groups distributed along the paraffin chain, such as the products made by reacting a long chain paraffin with sulfur dioxide and oxygen under ultraviolet light, followed by neutralization with NaOH or other suitable base (as in U.S. Pat. Nos. 2,503,280; 2,507,088; 3,260,741; 3,372,188; and German Pat. No. 735,096). The hydrocarbon substituent of the paraffin sulfonate preferably contains about 13 to 17 carbon atoms and the paraffin sulfonate will normally be a monosulfonate but, if desired, may be a di-, tri- or higher sulfonate. Typically, a paraffin disulfonate may be employed in admixture with the corresponding monosulfonate, for example, as a mixture of mono- and disulfonates containing up to about 30% of the disulfonate.

The hydrocarbon substituent of the paraffin sulfonate will usually be linear but branched chain paraffin sulfonates can be also employed. The paraffin sulfonate used may be terminally sulfonated or the sulfonate substituent may be joined to the 2-carbon or other carbon atom of the chain. Similarly, any di- or higher sulfonate employed may have the sulfonate groups distributed over different carbons of the hydrocarbon chain.

Additional water soluble anionic detergents include the higher (e.g. $C_{10-20}$) acyl sarcosinates, isethionates and taurides such as sodium lauroyl sarcosinate, the oleic acid ester of isethionic acid, and sodium or potassium N-methyl-N-lauroyl or -oleyl taurides. Another type of anionic detergent is a higher alkyl phenol mono- and/or di-sulfonate, such as one having an alkyl group of 9 to 25 carbon atoms, preferably a linear alkyl of about 16 to 22 carbon atoms, which may be made by sulfonating the corresponding alkyl pehnol to a product containing in excess of 1.6, preferably above 1.8, e.g., 1.8 to 1.9 or 1.95 $SO_3H$ groups per alkyl phenol molecule. In these sulfonates, the phenolic hydroxy group may be blocked, as by etherification or esterification; thus the H of the phenolic OH may be replaced by an alkyl, e.g., ethyl, or hydroxyalkoxyalkyl, e.g., a $—(CH_2CH_2O)_xH$ group in which x is 1 or more, such as 3, 6 or 10 and the resulting alcoholic OH may be esterified to form, say, a sulfate, e.g., $—OSO_3Na$. Still another type of anionic detergent is the $C_{8-20}$ alkanoyl, e.g. coconut oil fatty acid, mono-, di- and tri-glyceride sulfonates.

The above described types of synthetic detergents are representative of the anionic organic sulfonates operative as or in component B.

Other suitable anionic detergents useful as or in component B are the anionic organic alcohol sulfates, i.e. sulfate esters of an OH group-containing hydrophobic or oleophilic moiety such as the $C_{8-20}$ alkyl sulfates, e.g. lauryl and tallow alcohol sulfates, alpha- and omega-methoxy octadecyl sulfate, $C_{8-20}$ alkanoyl (e.g. coconut oil fatty acid) mono- and di-glyceride sulfates, and higher alkyl ($C_{9-25}$) phenol sulfates.

Still other suitable anionic detergents useful as or in component B are the ether sulfates which are sulfate esters of nonionic detergents, i.e. the reaction products of about 1 to 20 moles of a $C_{2-4}$ alkylene oxide, preferably ethylene oxide, with 1 mole of a $C_{8-24}$ reactive hydrogen-containing aliphatic or alicyclic compound including aliphatic and alicyclic alcohols such as lauryl, tallow, oxotridecyl, coconut oil, and abietyl alcohols, aliphatic dihydric alcohols such as polyoxypropylenated ethylene and propylene glycols, diamines, and dithiols, aliphatic and alicyclic carboxylic acids such as stearic acid, erucic acid and abietic acid, aliphatic mercaptans such as dodecyl mercaptan, aliphatic and alicyclic amines such as stearyl amine and rosin amine, and aliphatic amides such as stearyl amide, or with 1 mole of a $C_{8-24}$ reactive hydrogen-containing aromatic compound including alkyl phenols such as nonyl and dinonyl phenol.

While the aforementioned structural types of anionic organic sulfates and sulfonates are generally preferred, it will be understood that the corresponding organic phosphates (see e.g. U.S. Pat. No. 3,595,968) and phosphonates are also useful anionic detergents in component B.

Generally, the anionic detergents and preferably salts of alkali metals, such as potassium and especially sodium, although salts of ammonium cations and substituted ammonium cations derived from lower (2 to 4 carbon atoms) alkanolamines, e.g., triethanolamine, tripropanolamine, diethanol monopropanolamine, and from lower (1 to 4 carbon atoms) alkylamines, e.g., methylamine, ethylamine, secbutylamine, dimethylamine, tripropylamine and tri-isopropylamine, may also be utilized.

The aliphatic nonionic detergents operative as or in Component B may be described as reaction products of about 2 to 50 moles of a $C_{2-4}$ alkylene oxide, preferably ethylene oxide, with 1 mole of a $C_{8-24}$ reactive hydrogen-containing aliphatic compound, illustrative of which are those reactive hydrogen-containing compounds discussed above as precursors of sulfate esters of nonionic detergents which are aliphatic.

Preferred nonionic detergents are those represented by the formula:

$$RO(C_2H_4O)_nH$$

wherein R represents the residue of a saturated straight or branched chain aliphatic alcohol, preferably a primary alkanol of about 8 to 20, preferably about 12 to 18 carbon atoms and n is an integer from about 2 to 50, preferably about 3 to 20.

Typical commercial nonionic detergents suitable for use in the invention include an ethoxylation product, having an average of 11 ethylene oxide (E.O.) units, of a 14 to 15 carbon atom chain fatty alcohol, a 12 to 15 carbon atom chain fatty alcohol ethoxylated with an average of 7 E.O. units; a 16 to 18 carbon alkanol ethoxylated with an average of 10 to 11 E.O. units and the reaction products of an average of 11 moles E.O. with 1 mole of a $C_{14-15}$ primary alkanol, of 5 moles E.O. with 1 mole of a $C_{9-11}$ primary alkanol, and of 7 moles E.O. with 1 mole of a $C_{12-15}$ primary alkanol; and 3:1 of 1:3 blends of the reaction product of 20–50 moles E.O. with 1 mole of a $C_{16-18}$ primary alkanol, and of 3–5 moles E.O. with 1 mole of a $C_{9-10}$ primary alkanol. It will be understood that when a compound is indicated as containing a range of carbon atoms, it is actually one or a mixture of compounds individually containing a carbon atoms content within such range. Indicated E.O. values are similarly averages.

Other suitable nonionic aliphatic detergents include the liquid and semi-solid reaction products of about 3–20 moles E.O. with 1 mole of $C_{11-15}$ secondary alkanols, the reaction products of about 5–7 moles E.O. with 1 mole of $C_{16-18}$ alkane diols and the Pluronics including the reaction products of about 2–20 moles E.O. with higher molecular weight (e.g. at least about 150) polyoxypropylenated ethylene and propylene glycols, diamines and dithiols.

As indicated above, mixtures of the abovedescribed detergents may be employed as component B. A preferred embodiment is the use of at least about 50%, preferably about 65%, up to 100%, of a nonionic aliphatic detergent especially the nonionic reaction product of about 2 to 50, preferably about 5 to 15 moles of ethylene oxide with 1 mole of a saturated aliphatic alcohol, preferably a primary alkanol, of about 8 to 20, preferably about 11 to 16, carbon atoms, as or in component B, any balance being an anionic organic sulfonate or sulfate detergent. According to another embodiment, component B contains at least about 30%, up to 100%, of an anionic organic ether sulfate detergent. Examples of such embodiments include those wherein component B contains substantially 100% of the nonionic aliphatic detergent, such as the one described immediately above, or about 70% of such nonionic detergent and about 30% of the anionic detergent such as an alkylaryl sulfonate salt, especially sodium dodecylbenzene sulfonate, or substantially 100% of the anionic ether sulfate detergent such as sodium lauryl polyethyleneoxy (2–9) sulfate.

The detergents of component B contribute improved hard water solubility and improved detergency to the matrix compositions and pellets of this invention, particularly in hard water and/or with respect to the synthetic fibrous materials such as nylon, polyesters such as Dacron and polyacrylonitriles such as Orlon and Acrilan. They also increase the water-solubility and rates of wetting and dissolution of such compositions and pellets, but should not generally constitute more than about 65%, preferably no more than about 55% of the matrix to avoid the production of increasingly softer, tackier, more hygroscopic and less transparent products. This component B should contain little or no mineral salts, a fairly common ingredient of commercial detergent formulations, to avoid detrimental effects on the transparency properties of the matrix products, and may be employed in the matrix compositions and pellets of this invention in amounts ranging from about 10 to 65%, preferably about 20 to 55%, and still more preferably about 30 to 45% by weight.

A major portion (≧50%) and preferably from 75 to 100% of the component C solvent should be normally liquid, i.e. with a solidification point (S.P.) below about 40° C., preferably below room temperature, and a boiling point of at least about 100° C., preferably at least about 120° C., up to about 400° C. It should be substantially non-volatile, with a negligible vapour pressure at room temperature and negligible loss by evaporation on ageing or storage. Thus, particularly good non-volatility is indicated by a loss of weight of 5% or less after 2 hours at 105° C. or after 10 hours at 43° C. for a 20 gram sample of the solvent in a container with an evaporating surface of about 46.5 sq. cm. (2.3 sq. inches) placed in an over provided with a flow of air.

Of the said non-volatile fraction of said component C at least about 10% should be a dihydric alcohol to provide 10% thereof in component C and preferably at least 25% up to 100%. One or more substantially water insoluble organic solvents, such as benzyl alcohol, may constitute a part of the non-volatile fraction in an amount not more than about 90%, more preferably not more than about 75%, and still more preferably not above about 50% by weight of said fraction.

A particularly suitable water soluble organic solvent is propylene glycol. Preferably, the ratio of water insoluble to water soluble solvents in component C will fall within the range of about 1:10 to 10:1, preferably about 3:1 to 1:10, and more preferably 1:1 to 1:10. Other highly preferable ratios are 1:2 to 1:10 and 1:4 to 1:10.

For the purposes of this invention and solely as a general guide, a solvent may be considered water-insoluble if its solubility in water at 20° C. is less than 10% by weight and preferably less than about 5% by weight. Benzyl alcohol which is one of the preferred water-insoluble solvents has a reported solubility of 4 g per 100 ml of water at 17° C.

As a suitable substantially water insoluble organic solvent, benzyl alcohol is preferred, or lauryl alcohol or terpineol, but as illustrative of other such solvents which may be employed in or as component C, there may be mentioned, as a rule of thumb, any such liquid more water insoluble than benzyl alcohol, including generally any substantially water insoluble aliphatic, alicyclic or aromatic liquid hydrocarbon, halogenated (iodine, bromine or preferably chlorine) hydrocarbon, hydroxylated hydrocarbon, ether, ester, or the like having the above-described properties, for example octane, hexadecane, chlorohexane, chloro- and dichloro- benzene, heptyl, Oxotridecyl and hexadecyl alcohols, abietyl alcohol, octanediol, phenethyl alcohol, mono- and di-$C_{1-4}$ alkyl phenols, phenyl ether, benzyl ether, 1,2-dibutoxy benzene, 2- benzyloxyethanol, butyl ether, diethyl- and dibutyl- phthalates, benzyl propionate, isopropyl myristate, palmitate, and stearate, and the like.

Similarly, as a rule of thumb, the substantially water soluble solvent in or as component C may be any such solvent which is more water soluble than benzyl alcohol. It may be of any type chemically, but is generally a monohydric or polyhydric alcohol, ether alcohol, or amine such as 1,7- heptanediol, the mono- and polyethylene and -propylene glycols of up to about 4000 molecular weight, and the mono-$C_{1-4}$ alkyl ethers thereof, sorbitol, glycerol, glucose, diglycerol, sucrose, lactose, dextrose, 2- pentanol, 1- butanol, mono-, di- and triethanolamine, 2-amino-1- butanol, and the like, especially the polyhydric alcohols and alkanolamines.

The solvent component C is essential for the production of pellets which are transparent and further functions as a coupling or mutual solvent for the component A soap and its fatty acid precursor, and the component B detergent. It also fluidizes the melt and facilitates the shaping thereof into pellets which solidify rapidly on cooling in accordance with the process of this invention. It further improves the solubility of the pellet products. Substantially water soluble solvents in component C are good mutual or coupling solvents for components A and B, and good water solubilizers of the pellet products, but tend to increase the softness, tackiness and hygroscopicity thereof, particularly those of the polyhydric alcohol type, in storage and use. Such tendencies are controlled in accordance with this invention by limiting the proportions of water soluble solvents and employing water insoluble solvents in component C as described above. The water insoluble solvent, and particularly benzyl alcohol, also is unique in providing body and form-stability to the matrix products of this invention. It should however be noted that a controlled degree of hygroscopicity in the products thereof may be beneficial in preventing such products from drying out, shrinking and cracking in storage and use. Component C, like component B, should of course also be stable or resistant to the action of the base or alkaline material used in making the component A soap in situ according to the process of this invention.

Component C should not generally constitute more than about 65%, preferably no more than about 45%, still more preferably no more than about 25% of the matrix compositions and pellets of this invention to avoid unduly reducing the detergency properties thereof because of the resulting lower proportions of components A and B, and to avoid unduly increasing the sweating (liquids leakage) hygroscopicity, softness and tackiness of the pellets. In general, the matrix compositions and pellets of this invention may contain, approximately by weight, 10 to 45, preferably 10 to 35, and more preferably 10 to 30% of component C.

Particularly preferred proportions are the use of, approximately by weight, 1 to 2 parts of component A, 1 to 4 parts of component B, and 1 part of component C, in the compositions and pellets of this invention apart from water component D.

Water component D contributes to a lowering of the viscosity of the present compositions in the fluid or molten state, and facilitates neutralization of the fatty acid precursors of the component A soaps in the processes for making the pellets and compositions of this invention, in addition to assisting in solubilizing components A and B. Further, some if not all the water is conveniently introduced in the form of an aqueous solution of the base or alkaline material employed in the in situ neutralization or saponification of the fatty acid precursors of the component A soap. Water also increases the water solubility and transparency of the pellets of this invention and, due to its partial loss from the pellets by evaporation during ageing and storage, particularly from the outer layers of the pellets, reduces the surface stickiness and increases the hardness thereof. Too low a proportion of water detrimentally affects the workability of the present compositions and the transparency of the resulting pellets. Too high a proportion unduly reduces the rate of solidification of these compositions into pellets, and unduly increases the stickiness and softness thereof.

In general the compositions and pellets of this invention should contain, approximately by weight, 1 to 35 parts, preferably 5 to 25 parts, and more preferably 10 to 15 parts, of water component D, per hundred parts of (A), (B), and (C) and in general no more than about 15% by weight of component D in the matrix.

According to the process for preparing the matrix compositions of this invention, it is preferred to melt the free fatty acids corresponding to the soaps of component A in a heated vessel, mixing in components B and C, and gently stirring the mixture at a temperature above, but preferably no more than about 50° C. above the melting point of the said fatty acids until a homogeneous liquid is obtained. A solution of the selected salt forming base in water component D, preferably at the temperature of said homogeneous liquid, is then mixed therein, preferably gradually and/or in small increments to avoid lumps and overheating, until the in situ neutralization and/or saponification of the fatty acids in the said liquid is complete. Desirably, an approximately stoichiometric amount of the base is employed to avoid excess base or fatty acids in the product. Neutrality in the product can be ascertained for example by periodic testing with phenolphthalein indicator. If desired the detergent component B may be first dissolved in the heated solvent component C and the resulting solution filtered to remove mineral salts and any other undissolved material prior to mixing and the B and C components, in the form of the resulting hot clear solution, into the molten fatty acids.

After all the base has been added and the resulting hot liquid product mixed sufficiently until it is determined that the fatty acids are neutralized, any desired minor amounts of known additives for detergent formulations may be mixed in together, if desired with any desired additional amounts of water component D. Alternatively, some of the water component D may be added together with detergent component B and/or solvent component C.

In some instances, it may be desirable and within the scope of this invention to replace up to about 75% or more of the initially melted free fatty acids by their corresponding soaps or salts, e.g. neat or kettle soap, with of course a corresponding reduction in the proportion of soap- or salt-forming base subsequently mixed with the hot melt to neutralize or saponify the free fatty acids therein.

According to another embodiment of the invention, when a product is being prepared containing a heat sensitive anionic sulfonate or sulfate detergent as or in component B, such detergent is preferably not mixed with the molten fatty acids prior to the exothermic neutralization reaction thereof with the base, but is instead subsequently mixed into or with the previously neutralized and cooled liquid (to just above the solidification point of the said liquid containing the soap or fatty acid salt component A, the solvent component C, and any nonionic aliphatic detergent portion of component B).

The hot liquid composition of the invention produced as described above may if desired be cooled and solidified in bulk or any other desired form. According to a further feature of this invention, such cooled and solified composition is remelted, or more preferably said hot liquid composition is employed without such intermediate cooling, solidification, and remelting steps and/or evaporation, and use in the method of this invention for preparing transparent, water soluble, non-sticky, substantially non-hygroscopic detergent pellets.

Suitable pellet-preparing method may include the use of equipment (i.e. pipes, hoppers, containers, nozzles, valves, etc.) provided with suitable heating means effective for maintaining the temperature of the hot or molten liquid composition of the invention at just above its solidification point (i.e. about 2° C. up to about 50° C., preferably up to about 20° C., above said S.P.) until commencent of the formation of said drops falling from a suitable aperture or apertures. Such S.P.s may range from as low as about 40° C. up to about 100°-110° C. If much temperature is permitted to drop to or below such S.P., premature solidification will obviously be initiated prior to the desired drop and pellet formation. The flow of hot liquid composition to and through the apertures will be thereby reduced, impeded or halted completely.

If such temperature is too high, loss of some portions of the components, with consequent changes in the desired optimum proportions or ratios thereof, may occur by decomposition and/or evaporation or the like, and possible concomittant detrimental effects on composition and pellet properties such as pelletability (rate of solidification, etc.), viscosity, transparency, hardness, solubility, detergency, and/or hygroscopicity and the like. Undue loss of volatile components at such high temperatures may further result in premature solidification of soap component A and/or detergent component B in the equipment prior to drop and pellet formation. Still further, if the temperature of the liquid composition in the frops being formed at said apertures is too high, solidification into pellet formation on the said support below the apertures will be prevented, and the still completely liquid drops will strike the support and spatter or form a flat, continuous film thereon.

The viscosity of the hot liquid detergent composition is likewise an important factor, particularly in determining the out put rate (rate of drop formation) and the size of the drops. Such viscosities, measured by falling ball viscometer may range from about 50 to 3000 cps, preferably about 1000 to 2000 cps., and are inherent in the compositions of this invention.

Accordingly, the size of the apertures, the temperature, viscosity, and rate of solidification of the composition in the drops, the vertical distance between the aperturs and the support, and the temperatures of the support and the atmosphere between the apertures and the support are interdependent variables to be controlled for achieving the desired formation of pellets which may range in size (maximum dimension) from about 2 to about 9 mm., preferably about 3 to about 5 mm. and may have the shape of a disc, sphere, bean or lentil, tear drop or truncated version thereof or the like.

Generally, there should preferably be a plurality of apertures, say up to 500 or more, which may each range from about 0.5 to about 4 mm. in diameter, in the bottom of the container preferably provided with stirring means and holding the hot liquid detergent composition. The height between the apertures and the support may range from about 0.5 to 5, preferably about 1 to 2 cm. The apertures or nozzles and/or the container may be provided with vibrating means, preferably vibrating in a vertical direction, for the purpose of facilitating separation of the drops therefrom and preventing formation of stalagtites thereon. Such vibrating means may for example vibrate at a frequency of about 0.2 to 5 cycles per second, and desirably with such amplitude as to cause contact between the support and drop as it is forming.

It may be convenient to provide the support with vibrating means whereby it may serve an additional function of preventing sticking of the pellets to, and facilitating removal of the pellets from the support. The support, preferably moving, is of heat conductive material, preferably metal, such as a rotating cylinder or still more preferably in the form of an endless moving metal belt provided with means for continuously removing the pellets, such as angled knife scrapers, and also optionally provided with additional vertically or horizontally biased vibrating means to prevent sticking of the pellets to the support and facilitate their removal. Such support may in fact service a series of containers continuously depositing pellet-forming drops thereon. The temperature of the support and the atmosphere through which the drops descend should of course be well below the S.P. of the hot liquid detergent composition so that, with any particular composition, temperature thereof, size of drops, height between aperture and support, at least a substantial proportion of each drop is substantially solidified upon or prior to contacting the support. The underside of the support may for example be cooled by air blower or cooling liquid spray.

The pellets collected from the above described method should preferably be aged in warm dry air prior to packaging to promote hardness, non-stickiness.

It will of course be understood that transparent detergent pellets in accordance with this invention may also be made by processes other than as described above and may be of any other shape or configuration such as cylinders, cubes, pyramids, cones, etc.

The following examples are not limitive and are only illustrative of preferred embodiments of this invention. All amounts and proportions referred to herein and in the appended claims are by weight unless otherwise indicated.

Example 1, and the remaining examples in Table II, in conjunction with Table I, list and describe component ingredients and the amounts thereof employed in making compositions and pellets exemplary of the various features of this invention. In making such compositions, the fatty acids of component A are melted in a heated vessel, the solvent component C poured in, the detergent component B mixed in, and the mass heated with gentle stirring at a temperature not more than 50° C., generally not more than about 20° C., and usually about 2° to 10° C. above the melting point of said fatty acids until a homogeneous liquid is obtained. Such temperatures may range from about 60° to 110° C., generally about 70° to 100° C., and usually about 80° to 90° C. The water component D, with an approximately stoichiometric amount of caustic soda dissolved therein, and at about the temperature of the hot homogeneous liquid, is then gradually admixed therein to avoid lumps and overheating until completion of the neutralization and/or saponification of the fatty acids is completed. Completion can be ascertained by periodic testing with phenolphthalein indicator, or by adding a few drops of such indicator to the hot homogeneous liquid and watching for development of a pink shade. In making formulations employing heat sensitive anionic sulfonated and/or sulfate detergents in component B, such detergents may instead be added to the heated vessel only after neutralization with the caustic soda and the cooling of the neutralized liquid to from about 1° to 50° C. above its S.P., to minimize thermal decomposition of the heat sensitive anionic detergent.

If the heated vessel in which the mixing and neutralization is conducted is not provided with pellet-making apertures as described below, the resulting hot liquid compositions of the invention are then transferred, while maintaining their temperatures above their S.P.s, to a heated container in the bottom of which are a plurality of apertures or nozzles with adjustable openings ranging from about 0.5 to 2 mm., usually about in 1 mm., in diameter. The hot liquid drops forming at the exits of the nozzles descend through an atmosphere at a temperature below the S.P. of the composition for a distance of from about 1 to 2 cm., onto an endless moving metal belt provided with vertical vibrating means and cooled to well below (up to 20°–30° C. below) said S.P.s. Solidification of the drops commence as they separate from the nozzles and is at least partially completed upon or prior to contacting the belt so that pellets with a maximum dimension averaging about 2–9 mm., usually about 3–5 mm., are formed. At a suitable distance from the nozzles, an angled knife scraper removes the completely solidified pellets from the belt into a container or conveyor for ageing, packaging, etc.

All the compositions and pellets of the Examples in Table II have acceptable, good or excellent properties with respect to hot melt viscosity, pelletability, transparency, hardness, dissolution speed (rate of water solubility), hygroscopicity, and detergency.

TABLE I

| INGREDIENTS | |
|---|---|
| COMPONENT A | |
| A1 | Hydrogenated tallow fatty acids |
| A2 | Distilled coconut oil fatty acids |
| A3 | Distilled tallow fatty acids |
| A4 | $C_{11-13}$ Synthetic fatty acids |

TABLE I-continued

| INGREDIENTS | |
|---|---|
| A5 | $C_{22}$ Fatty acids |
| A6 | Commercial stearic acids |
| A7 | Neat soap (15:85 A2 soap:A3 soap + 33% water) |
| | COMPONENT B |
| B1 | Nonionic reaction product of 1 mole of $C_{14-15}$ primary alkanols with about 11 moles of ethylene oxide (+ 11 E.O.) |
| B2 | Nonionic $C_{12-15}$ primary alkanols + 11 E.O. |
| B3 | Nonionic $C_{12-15}$ primary alkanols + 7 E.O. |
| B4 | Nonionic $C_{9-11}$ primary alkanols + 5 E.O. |
| B6 | Nonionic $C_{15}$ secondary alkanol + 3 E.O. |
| B7 | Nonionic $C_{16}$ alkanediol (omega omega) + 5 E.O. |
| B8 | Anionic sodium $C_{10-14}$ (av. dodecyl) alkyl benzene sulfonate. |
| B9 | Anionic sodium sulfate of lauryl alcohol + 3 E.O. |
| B10 | Anionic sodium $C_{14-17}$ paraffin sulfonate |
| B11 | Anionic sodium lauryl sulfate |
| | COMPONENT C |
| C1 | Benzyl alcohol |
| C2 | Lauryl alcohol |
| C3 | Terpincol |
| C4 | Diethyl phthalate |
| C5 | Phenethyl alcohol |
| C6 | Propylene glycol |
| C7 | Monoethylene glycol |
| C8 | Diethylene glycol |
| C9 | Triethylene glycol |
| C10 | Polyethylene glycol F200 |
| C11 | Triethanolamine |
| | COMPONENT D |
| D1 | 35% aqueous caustic solution |
| D2 | Deionized water |
| D3 | 49% aqueous caustic soda solution |
| D4 | 50% aqueous caustic potash solution |
| | ADDITIVES E |
| E1 | Optical dye, e.g. |
| E2 | Dye, e.g. Pigmenol Blue 5G |
| E3 | Perfume |

TABLE II

| | EXAMPLES COMPONENTS - PARTS BY WEIGHT | | | | |
|---|---|---|---|---|---|
| Example | A | B | C | D | ADDITIVES |
| 1 | 11.0 A1 | 45.2 B1 | 11.4 C1 | 10.5 D1 | |
| | 11.0 A2 | | 11.4 C6 | 7.0 D2 | |
| 2 | 14.0 A1 | 42.0 B1 | 12.0 C1 | 10.2 D1 | 0.1 E1 |
| | 8.0 A2 | | 12.0 C6 | 5.0 D2 | 0.004 E2 |
| 3 | 11.0 A1 | 35.2 B1 | 11.4 C1 | 10.5 D1 | |
| | 11.0 A2 | 10.0 B8 | 11.4 C6 | 7.5 D2 | |
| 4 | 15.0 A1 | 30.0 B1 | 11.5 C1 | 14.4 D1 | 0.25 E1 |
| | 15.0 A2 | 7.0 B4 | 1.5 C6 | 10.0 D2 | 0.004 E2 |
| | | | 10.0 C11 | | |
| 5 | 11.0 A1 | 45.2 B9 | 15.0 C1 | 10.0 D1 | |
| | 11.0 A2 | | 11.4 C6 | | |
| 6 | 11.0 A1 | 40.0 B1 | 12.5 C1 | 10.0 D1 | 0.25 E1 |
| | 11.0 A2 | 5.0 B4 | 12.5 C6 | 4.15 D2 | 0.003 E2 |
| | | | | | 0.30 E3 |
| 7 | 15.0 A1 | 10.0 B1 | 20.0 C1 | 17.1 D1 | 0.005 E2 |
| | 20.0 A2 | | 20.0 C6 | 10.0 D2 | |
| 8 | 11.0 A1 | 45.2 B2 | 11.4 C1 | 10.5 D1 | |
| | 11.0 A2 | | 11.4 C6 | 6.0 D2 | |
| 9 | 15.0 A1 | 20.0 B1 | 15.0 C1 | 14.4 D1 | 0.25 E1 |
| | 15.0 A2 | 10.0 B4 | 5.0 C11 | 10.0 D2 | 0.003 E2 |
| | | 10.0 B7 | | | 0.350 E3 |
| 10 | 14.0 A1 | 25.0 B1 | 17.5 C1 | 13.4 D1 | 0.25 E1 |
| | 14.0 A2 | | 17.5 C6 | 8.0 D2 | 0.004 E2 |
| | | | | | 0.30 E3 |
| 11 | 14.0 A1 | 40.0 B1 | 6.0 C1 | 13.4 D1 | 0.25 E1 |
| | 14.0 A2 | | 6.0 C2 | 8.0 D2 | 0.003 E2 |
| | | | 6.0 C6 | | 0.30 E3 |
| | | | 6.0 C8 | | |
| 12 | 14.0 A1 | 40.0 B2 | 6.0 C1 | 13.4 D1 | 0.25 E1 |
| | 14.0 A2 | | 6.0 C4 | 8.0 D2 | 0.004 E2 |
| | | | 6.0 C6 | | 0.35 E3 |
| | | | 6.0 C10 | | |
| 13 | 14.0 A1 | 40.2 B2 | 6.0 C1 | 13.4 D1 | 0.25 E1 |
| | 14.0 A2 | | 6.0 C2 | 8.0 D2 | 0.004 E2 |

TABLE II-continued

| | EXAMPLES COMPONENTS - PARTS BY WEIGHT | | | | |
|---|---|---|---|---|---|
| Example | A | B | C | D | ADDITIVES |
| | | | 4.0 C7 | | 0.30 E3 |
| | | | 4.0 C8 | | |
| | | | 4.0 C9 | | |
| 14 | 14.0 A1 | 40.0 B1 | 6.0 C2 | 13.4 D1 | 0.25 E1 |
| | 14.0 A2 | | 6.0 C3 | 8.0 D2 | 0.004 E2 |
| | | | 12.0 C6 | | 0.30 E3 |
| 15 | 15.0 A1 | 40.0 B2 | 12.0 C1 | 12.0 D1 | |
| | 7.0 A4 | | 12.0 C8 | 7.0 D2 | |
| 16 | 14.0 A1 | 25.0 B9 | 17.5 Cl | 13.4 D1 | |
| | 14.0 A2 | | 17.5 C6 | 8.0 D2 | |
| 17 | 7.0 A1 | 22.5 B2 | 15.3 C1 | 7.0 D1 | |
| | 7.0 A2 | 15.3 B10 | 15.3 C6 | 2.0 D2 | |
| | 7.0 A3 | | | | |
| 18 | 7.0 A1 | 22.5 B2 | 14.3 C1 | 7.0 D1 | |
| | 7.0 A2 | 15.3 B10 | 14.3 C6 | 2.0 D2 | |
| | 7.0 A3 | | 2.0 C11 | | |
| 19 | 8.0 A1 | 13.5 B9 | 18.4 C1* | 8.1 D1 | |
| | 8.0 A2 | 13.5 B10 | 18.4 C6 | | |
| | 8.0 A3 | | | | |
| 20 | 25.0 A1 | 25.0 B1 | 15.0 C1 | 10.0 D1 | |
| 21 | 10.0 A1 | 7.0 B1 | 15.0 C1 | 11.3 D3 | |
| | 20.0 A6 | 7.0 B6 | 24.0 C6 | 5.0 D2 | |
| 22 | 30.0 A1 | 15.0 B1 | 10.0 C1 | 8.3 D3 | |
| | | | 25.0 C6 | 8.3 D2 | |
| 23 | 25.4 A1 | 21.1 B1 | 16.9 C1 | 7.0 D3 | |
| | | | 21.1 C6 | 8.5 D2 | |
| 24 | 30.0 A6 | 15.0 B1 | 20.0 C1 | 5.0 D2 | |
| | | | 20.0 C6 | 10.0 D3 | |
| 25 | 13.0 A1 | 40.0 B1 | 12.5 C1 | 4.3 D1 | |
| | 17.0 A7 | | 12.5 C6 | | |
| 26 | 18.8 A1 | 10.0 B8 | 15.0 C1 | 17.9 D1 | |
| | 18.8 A2 | 10.0 B9 | 15.0 C2 | | |
| 27 | 11.0 A1 | 35.2 B1 | 11.4 C1 | 10.5 D1 | |
| | 11.0 A2 | 10.0 B11 | 11.4 C6 | 7.5 D2 | |

*Similar good results when 2.5 parts of each of C1 and C6 in Example 19 replaced by cocodiethanolamide.

The compositions of this invention, in addition to the aforedescribed characteristics, generally also are of the low—or lower—foaming type, particularly where the detergent B is non-ionic. The combination of non-ionic detergents and non-ionic—containing detergent mixtures (with, for example, alkylbenzene sulfonates, olefin sulfonates, paraffin sulfonates, etc. and mixtures thereof) with the higher fatty acid soaps is known to give a low—foaming or, indeed, in many cases, a synergistically low—or lower—foaming product which is especially useful in high temperature (e.g. >60° C. to the boil) machine laundering processes. Non-ionics of optimum detergency characteristics and in amounts to give acceptable and more than acceptable performance are difficult to produce in the form of conventional spray dried products and the present invention, inter alia, makes available outstanding low-foaming formulations, particularly with high non-ionic content which affords a salutory solution to the problem.

COMPARATIVE EXAMPLES

28. When 50 parts of B8 are mixed with 50 parts of C6 at about 100° C., the resulting soapless mixture does not solidify on cooling to room temperature.

29. Similar results are obtained when Example 28 is repeated substituting C1 for C6.

30. Similar results are obtained when Example 28 is repeated substituting half of the C6 by C1.

31. Similar results are obtained when Example 28 is repeated substituting B1 for B8.

32. When the procedure of Example 1 is followed mixing 10 parts of hot D1 into a hot molten liquid at about 70° C. containing 10 parts of A1, 95 parts of B1 and 95 parts of B6, the resulting hot liquid, containing no solvent component C and too little soap component A, is too viscous when hot, and very soft and opaque when cooled to room temperature.

33. When the procedure of Example 1 is followed mixing a stoichiometric amount of hot B1 into a hot molten liquid at about 80° C., containing 70 parts of A1, 65 parts of B1 and 65 parts of B6, the resulting hot molten liquid containing no solvent component C, is very viscous and serated, and is hard but opaque and sticky when cooled to room temperature.

The compositions set forth in the foregoing Table II illustrate embodiments of the transparent matrix formulations of this invention. While such compositions as hereinbefore described are outstandingly functional and uncommonly esthetic, particularly when in pigmented or dyed form, they may also form the basis for detergents of generally similar physical characteristics as to form-stability, size, shape, free-flowability, lack of tackiness or sticknesses, water-solubility, hardness, but of greatly varying properties as to soil removal, foam properties, etc. by the incorporation into such matrix formulations of this invention of any of the conventional detergent adjuvants as well as other components as hereinafter described. Among such materials mentioned may be made of fillers (e.g. silica, bentonite, insoluble silicates, molecular sieve components, etc.); inorganic builders (e.g. bicarbonates, borates, carbonates, phosphates, silicates, etc.); oxidizing agents (e.g. perborates, percarbonates, persulfates, etc.); organic builders (e.g. aminopoly - carboxylates, such as: mitrilotriscetic acid, trisodium salt, sodium ethylene diamine tetra-acetate, disodium hydroximinodi acetate, 1,2 diamino cylclohexane diacetic acid; polyelectrolytes; phosphonates; citrates; gluconates; brighteners; u-v absorbers; foam regulating agents (e.g. high molecular weight soaps, polysiloxanes, fatty amines, etc.); foam boosters (e.g. amine oxides, fatty acids alkanolamides etc.); specialty surfactants (e.g. cationics, amphoterics, ampholytics); germicides; preservatives, etc.

Additives of the aforementioned type may be employed in any desired quantities to effect the desired functional characteristics, thus such components as preservatives, germicides, dyes, pigments and U.V. absorbers are generally used in minor amounts e.g. 001% by weight up to 10% by weight. Other additives can be used at any level e.g. Fillers (1–75%); builders (1–85%); foam boosters (1–75%); defoamers and foam control agents (0.1–20%); sequentrants (0.1–20%); oxidizing agents (1–50%), etc.

Of particular value is the incorporation of builders and additives which may have thermal or other environmental instability. In this regard of particular note is the use of U.V. absorbers, brighteners and foam control agents especially of the polysiloxane type.

Of the inorganic builders, which are preferably used as the alkali metal (e.g. tripolyphosphate, pyrophosphate, hexametaphosphate, etc) are conventionally used and from these sodium tripolyphosphate (anhydrous, hydrated, hexahydrate) is usually the builder of choice with tetra potassium pyrophosphate somewhat less preferable due primarily due to cost factors.

The compositions of this mention which employ the transparent matrix base with any and all of the aforedescribed adjuvents may be similar in appearances (e.g. transparency) as the matrix base itself or may be more or less transparent ranging from highly transparent to translucent to opaque. In any event the translucent and opaque products are also of particularly pleasing and unique appearance.

The following examples illustrate transparent matrix combinations with other adjuvants:

EXAMPLE 34

65 parts of the composition of Example 1 (before pelletizing) and while in the fluid state (T+70° C.) are thoroughly mixed with 35 parts of anhydrous sodium tripolphosphate, and thereafter the composition is pelletized as in Example 1. The resulting pellets are free-flowing, non-tacky, readily water-soluble and have excellent laundry performance characteristics. The pellets are a dense, opaque white and have a very unique polished white marble appearance.

EXAMPLE 35

Example 1 is repeated with the addition of 0.2 parts of brightener (Optiblanc LSN) added to the composition. The brightener is first dissolved in the solvent and then the procedure followed is similar to Example 1. Excellent transparent pellets are produced.

EXAMPLE 36

Example 1 is repeated except that the solvent mixture used is 20 parts propylene glycol and 2.8 parts benxyl alcohol.

EXAMPLE 37

Example 1 is further repeated except that the solvent is all 20 parts propylene glycol.

EXAMPLE 38

EXAMPLE 1 is still further repeated using as the non-ionic a $C_{13-15}$ alcohol ethoylate containing 11 moles of condensed ethylene oxide.

EXAMPLE 39

EXAMPLE 1 is more repeated replacing half the non-ionic with component B-3.

This invention has been disclosed with respect to preferred embodiments thereof, and it will be understood that modifications and variations thereof will become obvious to workers skilled in this art which are to be included within the spirit and purview of this invention and the scope of the appended claims.

EXAMPLE 40

EXAMPLE 34 is repeated except that in place of the 35 parts of tripolyphosphate there are used 35 parts of a molecular sieve zeolete type A as described in German Offenlegungschrifts No. 2412836 and No. 2412837 published Oct. 31, 1974. Specifically, the zeolete is type A100 sodium aluminum silicate containing 20% $H_2O$ mean particle diameter 5.9—5.4 microns, pore size about 4 Angstroms.

EXAMPLE 41

EXAMPLE 34 is repeated using 35 parts Linde Type 4A molecular sieve (Union Carbide Corp.) having an average pore size of 8 Angstroms and an average particle size of 8.3 microns in place of the phosphate.

EXAMPLE 42

EXAMPLE 34 is repeated replacing half of the phosphate with an equal weight of the zeolete of Example 40.

EXAMPLE 43

EXAMPLE 34 is again repeated replacing the 35 parts of phosphate with an equal weight of PLAC (poly hydroxy acrylic acid lactone).

I claim:

1. A detergent composition comprising

I. a matrix of (A) soap, (B) synthetic detergent, and (C) solvent component; the soap component (A) constituting from 15 to 50% by weight of the matrix, comprising a water soluble alkali metal, alkaline earth metal, ammonium or amine salt or a $C_{6-22}$ fatty acids said soap component providing in the matrix not more than about 30% of salts of fatty acid of more than 18 carbon atoms and of the soap present no more than 70% is $C_{18}$ fatty acid and no more than 50% is unsaturated fatty acid and no more than 25% of said salts being potassium salts and wherein the soap has a weighted average carbon content of at least $C_{14}$; the synthetic detergent component (B) constituting from 10 to 65% by weight of the matrix and comprising at least one water-soluble member of the group consisting of (1) anionic $C_{10}$ to $C_{20}$ alkyl benzene sulfonates, (2) anionic $C_{10}$ to $C_{25}$ olefin sulfonates, (3) anionic $C_{10}$ to $C_{20}$ paraffin sulfonates, (4) anionic $C_8$ to $C_{20}$ alcohol sulfates (5) anionic sulfate and phosphate esters having the molecular configuration of the reaction product of 1 to 20 moles of a $C_2$ to $C_4$ alkylene oxide with (A) a $C_8$ to $C_{24}$ aliphatic or alicyclic mono and dihydric alcohol, mono and di amine or monocarboxylic acid and (B) a $C_8$ to $C_{24}$ aliphatic amide or mercaptan, (6) anionic $C_8$ to $C_{20}$ alkanoyl mono,-di,- and triglyceride sulfonates, (7) anionic $C_{10}$ to $C_{20}$ acyl sarcosinates, (8) anionic $C_{10}$ to $C_{20}$ acyl isethionates, (9) anionic $C_{10}$ to $C_{20}$ acyl taurides, (10) anionic $C_9$ to $C_{25}$ phenol mono or disulfonates, and (11) aliphatic nonionic compounds having the molecular configuration of the reaction product of 2 to 50 moles of a $C_2$ to $C_4$ alkylene oxide per mole of a $C_8$ to $C_{24}$ reactive hydrogen-containing aliphatic compound, but a maximum of about 35% when said synthetic detergent component (B) consists essentially only of anionic organic sulfonates or anionic alcohol sulfates or mixtures thereof; and the solvent component (C) constituting from 10 to 45% by weight of the matrix and comprising a normally liquid, substantially non volatile organic solvent having a boiling point of at least 100° C., at least 10% thereof being a water-soluble dihydric alcohol and providing at least 10% thereof in solvent component C, said nonvolatile solvent including not more than about 90% thereof of a water insoluble solvent; and II. A water component (D) constituting from 1 to 35 parts per 100 parts of said matrix I, said matrix and water component being adapted to yield substantially nontacky, transparent, shaped forms which are free flowing and readily soluble in pelletized form.

2. A composition as defined in claim 1 containing about 20 to 45% of component A, 20 to 55% of component B, 10 to 30% of component C, and 5 to 25 parts of water per 100 parts of matrix.

3. A composition as defined in claim 1 containing about 25 to 35% of component A, 30 to 45% of component B, 10 to 35% of component C, and 10 to 15 parts of water per 100 parts of matrix.

4. A composition as defined in claim 1 wherein at least about 40% of component A are the alkali metal salts of hydrogenated tallow fatty acids.

5. A composition as defined in claim 1 wherein at least about 35% of component A are the alkali metal salts of distilled coconut oil fatty acids.

6. A composition as defined in claim 1 wherein more than about 50% of component C are water soluble solvents.

7. Pellets as defined in claim 1 having maximum dimension averaging about 2 to 9 mm.

8. A composition as defined in claim 1 wherein at least about 30% of component B is an anionic organic ether sulfate.

9. A composition as defined in claim 8 wherein said anionic ether sulfate is an alkali metal, ammonium or amine sale of a sulfate ester of the reaction products of about 1 to 20 moles of ethylene oxide with 1 mole of a reactive hydrogen-containing compound of about 8 to 24 carbon atoms.

10. A composition as defined in claim 1 wherein at least about 50% of component B is a nonionic aliphatic detergent.

11. A composition as defined in claim 10 wherein said nonionic aliphatic detergent is a reaction product of about 2 to 50 moles of ethylene oxide with 1 mole of a saturated aliphatic alcohol of about 8 to 20 carbon atoms.

12. A composition as defined in claim 1 wherein about 10 to 90% of component C is a water insoluble component which is at least one member of the group consisting of benzyl alcohol, lauryl alcohol or terpincol, and about 90 to 10% is a water soluble component which is at least one member of the group consisting of water soluble polytydric alcohols and alkanolamines.

13. A composition as defined in claim 12 wherein about 10 to 50% of component C is said water insoluble component and about 90 to 50% of component C is said water soluble component.

14. A composition as defined in claim 13 wherein at least about 40% of component A are the alkali metal salts of hydrogenated tallow fatty acids and at least about 3% are the alkali metal salts of distilled coconut oil fatty acids, at least about 50% of component B is the nonionic reaction product of about 2 to 50 moles of ethylene oxide with 1 mole of a saturated aliphatic alcohol of about 8 to 20 carbon atoms, and component D consists of about 5 to 25 parts of water per 100 parts of matrix.

15. Transparent, water soluble, non-sticky, substantially non-hygroscopic detergent pellets having a basis of a composition as defined in claim 1.

* * * * *